US007540338B2

(12) United States Patent
Belik

(10) Patent No.: US 7,540,338 B2
(45) Date of Patent: Jun. 2, 2009

(54) SINGLE JOINT DRILLING SYSTEM WITH INCLINED PIPE HANDLING SYSTEM

(75) Inventor: Jaroslav Belik, Pearland, TX (US)

(73) Assignee: National Oilwell Varco, L.P., Houston, TX (US)

( * ) Notice: Subject to any disclaimer, the term of this patent is extended or adjusted under 35 U.S.C. 154(b) by 167 days.

(21) Appl. No.: 11/458,520

(22) Filed: Jul. 19, 2006

(65) Prior Publication Data

US 2007/0017703 A1 Jan. 25, 2007

Related U.S. Application Data

(60) Provisional application No. 60/700,624, filed on Jul. 19, 2005.

(51) Int. Cl.
*E21B 19/14* (2006.01)

(52) U.S. Cl. ..... 175/57; 175/52; 175/85; 414/22.55; 414/22.58

(58) Field of Classification Search ..... 175/85, 175/57, 52; 414/22.55, 22.58, 22.61
See application file for complete search history.

(56) References Cited

U.S. PATENT DOCUMENTS 4,099,630 A * 7/1978 Beck ..... 414/22.52
4,310,283 A * 1/1982 Teague ..... 414/800
4,403,898 A * 9/1983 Thompson ..... 414/22.58
4,643,624 A * 2/1987 Murphree ..... 414/22.61
4,921,386 A * 5/1990 McArthur ..... 414/22.51
5,107,940 A * 4/1992 Berry ..... 175/85
5,127,790 A * 7/1992 Teague ..... 414/800
6,343,662 B2 * 2/2002 Byrt et al. ..... 173/4
6,695,559 B1 * 2/2004 Pietras ..... 414/22.57
6,857,483 B1 * 2/2005 Dirks et al. ..... 175/52
6,994,505 B2 * 2/2006 Hawkins, III ..... 414/22.54
2001/0025727 A1 * 10/2001 Byrt et al. ..... 175/7
2003/0170095 A1 * 9/2003 Slettedal ..... 414/22.59

* cited by examiner

*Primary Examiner*—Shane Bomar
(74) *Attorney, Agent, or Firm*—Conley Rose, P.C.

(57) ABSTRACT

A pipe handling system comprises a pipe erector that is operable to move a pipe from a horizontal storage position to an inclined position. In the inclined position, an upper end of the pipe is adjacent to an elevated drill floor of a drilling rig and the pipe is at an angle between horizontal and vertical. The pipe handling system also comprises a guide system that is operable to engage the pipe and control lateral movement of the pipe as it is moved from being supported in the inclined position by the pipe erector to a vertical position supported by the drilling rig.

17 Claims, 22 Drawing Sheets

SINGLE JOINT DRILLING SYSTEM WITH INCLINED PIPE HANDLING SYSTEM

CROSS-REFERENCE TO RELATED APPLICATIONS

This application claims priority to U.S. Provisional Patent Application No. 60/700,624, filed on Jul. 19, 2005 and titled "Single Joint Drilling System," which is hereby incorporated by reference herein.

STATEMENT REGARDING FEDERALLY SPONSORED RESEARCH OR DEVELOPMENT

Not Applicable.

BACKGROUND

The present invention relates generally to methods and apparatus for drilling wells. More specifically, the present invention relates to systems for drilling wells utilizing single joints of pipe.

Many smaller drilling rigs store tubular members, such as drill pipe, drill collars, and casing, in horizontal storage areas outside of the rig. As the different tubular members are needed, they are brought to the drill floor one at a time and added to the string. Handling these tubular members has historically been a highly manual job using winches or other lifting appliances within the rig. Automated systems for use in these "single joint" rigs must be able to safely handle a variety of tubular members while not slowing down drilling or tripping processes.

Thus, there remains a need to develop methods and apparatus for pipe handling and drilling systems, which overcome some of the foregoing difficulties while providing more advantageous overall results.

SUMMARY OF THE PREFERRED EMBODIMENTS

Embodiments of the present invention include a pipe handling system comprising a pipe erector operable to move a pipe from a horizontal storage position to an inclined position where an upper end of the pipe is adjacent to an elevated drill floor of a drilling rig. In the inclined position, the pipe is at an angle between horizontal and vertical. The pipe handling system also comprises a guide system that is operable to engage the pipe and control lateral movement of the pipe as it is moved from being supported in the inclined position by the pipe erector to a vertical position supported by the drilling rig.

Thus, the embodiments of present invention comprise a combination of features and advantages that enable substantial enhancement of moving pipe and other tubular members to and from a drilling rig. These and various other characteristics and advantages of the present invention will be readily apparent to those skilled in the art upon reading the following detailed description of the preferred embodiments of the invention and by referring to the accompanying drawings

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

Figure 1:
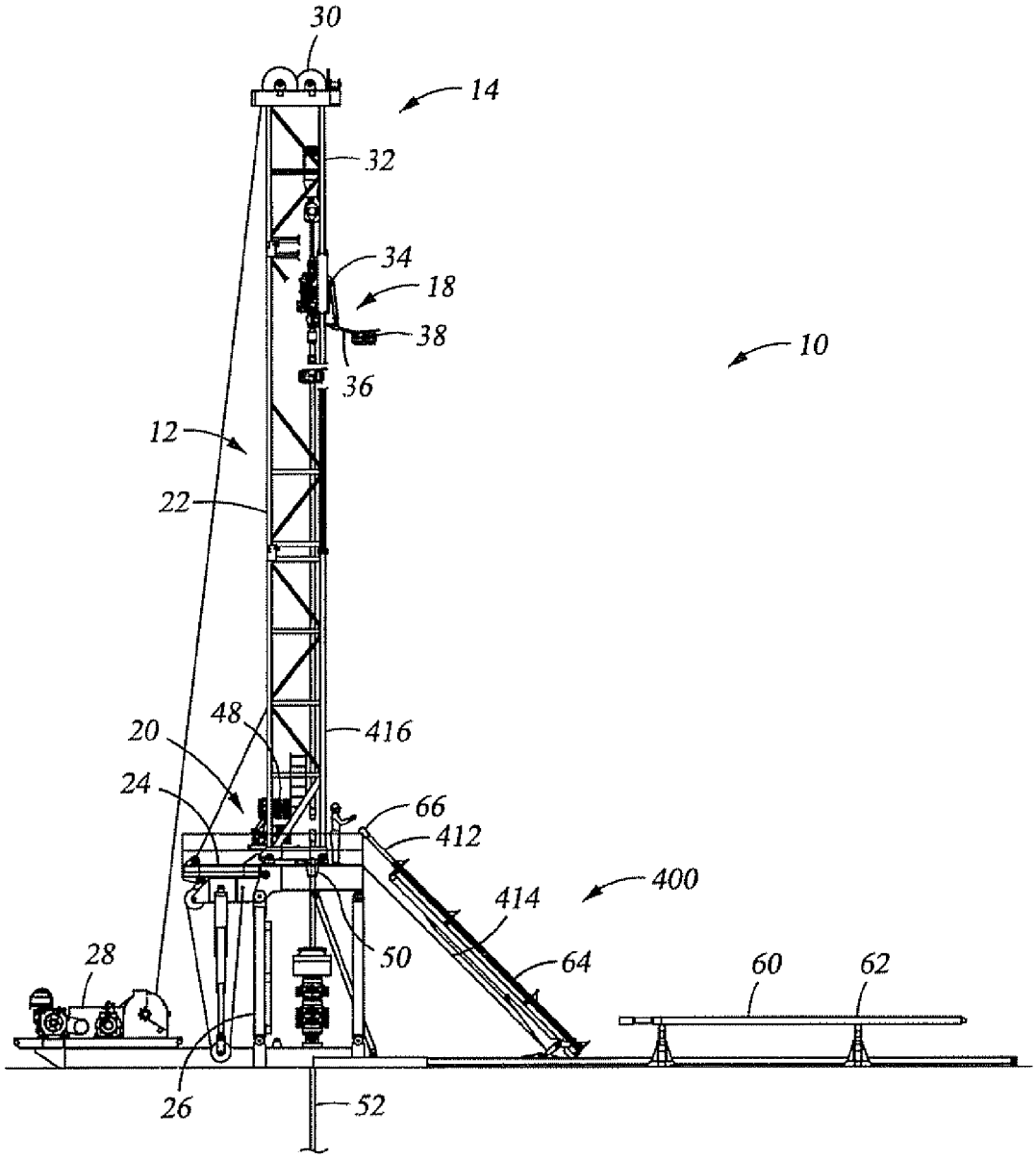
FIG. 1 is an elevation view of a drilling system utilizing a pipe erector system designed in accordance with embodiments of the present invention.

Referring now to FIG. 1, drilling system 10 comprises rig structure 12, hoisting system 14, pipe erector system 400, top drive system 18, and drill floor equipment 20. Rig structure 12 comprises mast 22, elevated drill floor 24, and sub-structure 26. Hoisting system 14 comprises drawworks 28, crown block 30, and traveling block 32. Top drive system 18 comprises top drive 34, bails 36, and elevator 38. Drill floor equipment 20 comprises iron rough-neck system 48 and slips 50 that are located on well center 52. Pipe erector system 400 moves drill pipe 60 from a horizontal storage position 62 to an inclined position 64 where the upper end 66 of the drill pipe is substantially adjacent to elevated drill floor 24.

Figure 2:
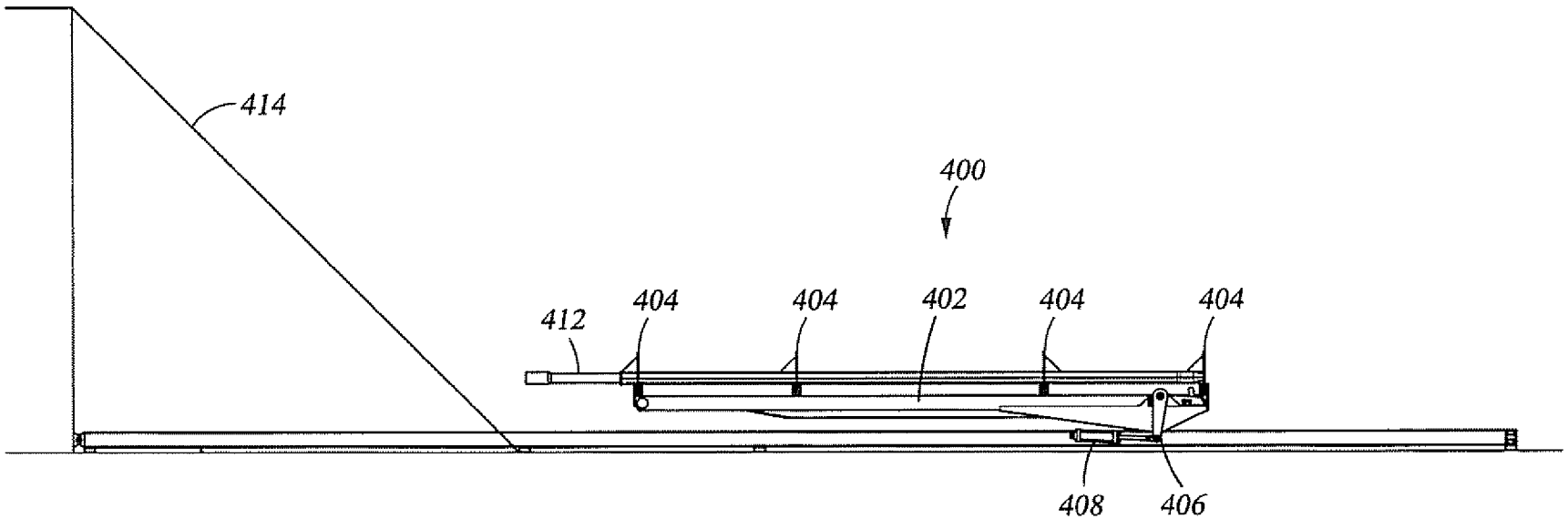
FIG. 2 illustrates the pipe erector system of FIG. 1 in a horizontal position.
Figure 3:
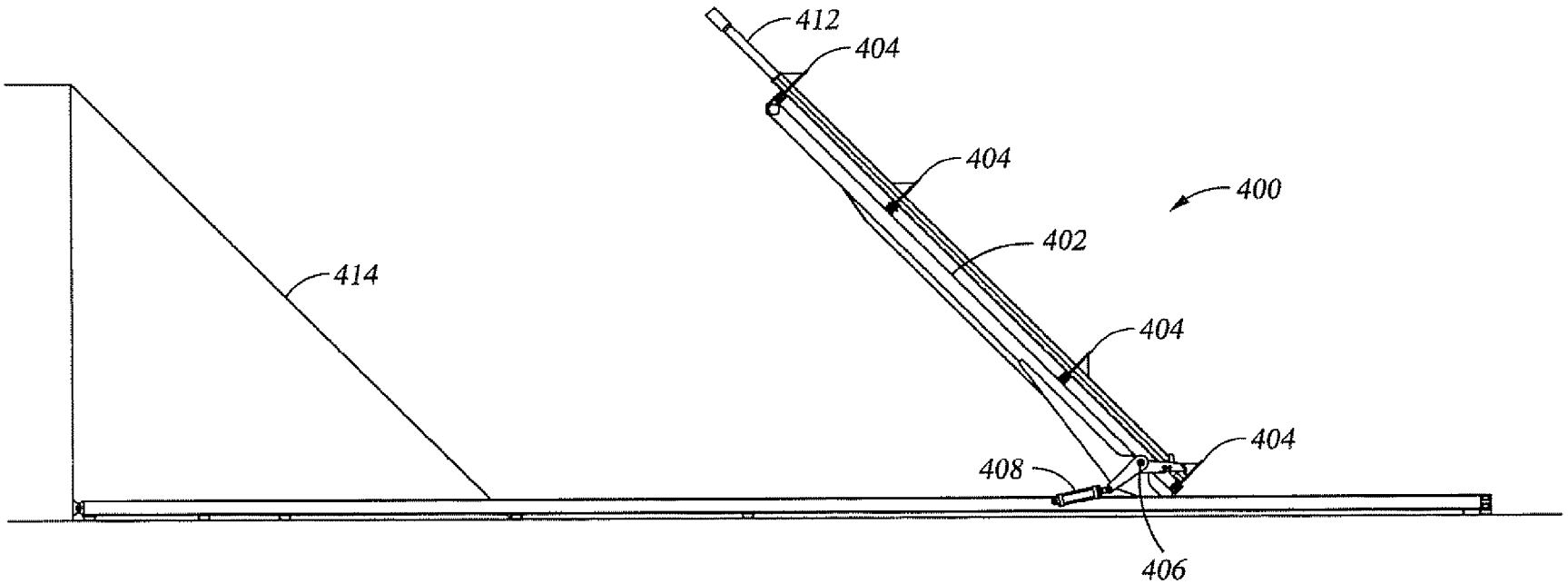
FIG. 3 illustrates the pipe erector system of FIG. 1 in a first elevated position.
Figure 4:
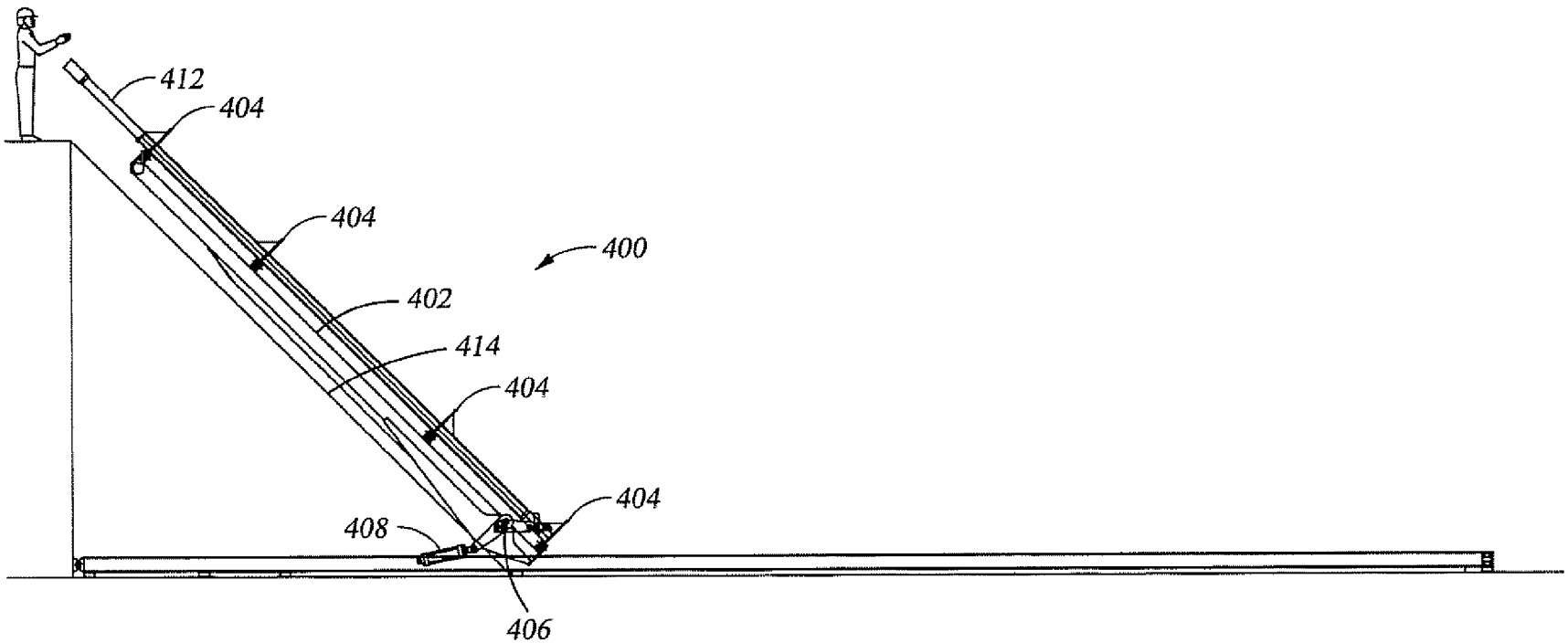
FIG. 4 illustrate the pipe erector system of FIG. 1 in a second elevated position.

Referring to FIGS. 2-4, erector system 400 comprises erector frame 402, pipe guides 404, pivot 406, elevating cylinder 408, and rail 410. Erector system 400 is utilized to elevate pipe 412 from horizontal, as in FIG. 1, and move the pipe to ramp 414 of rig 416. Pipe 412 is received by pipe guides 404 mounted on frame 402. Elevating cylinder 408 elevates frame 402 to an angle so that the axis of pipe 412 is substantially parallel to ramp 414, Frame 402 is then moved along rail 410 until pipe 412 is adjacent to ramp 414, Once on ramp 414, an elevator, Or some other lifting mechanism can engage pipe 412 and lift the pipe into rig 416.

Figure 5A:
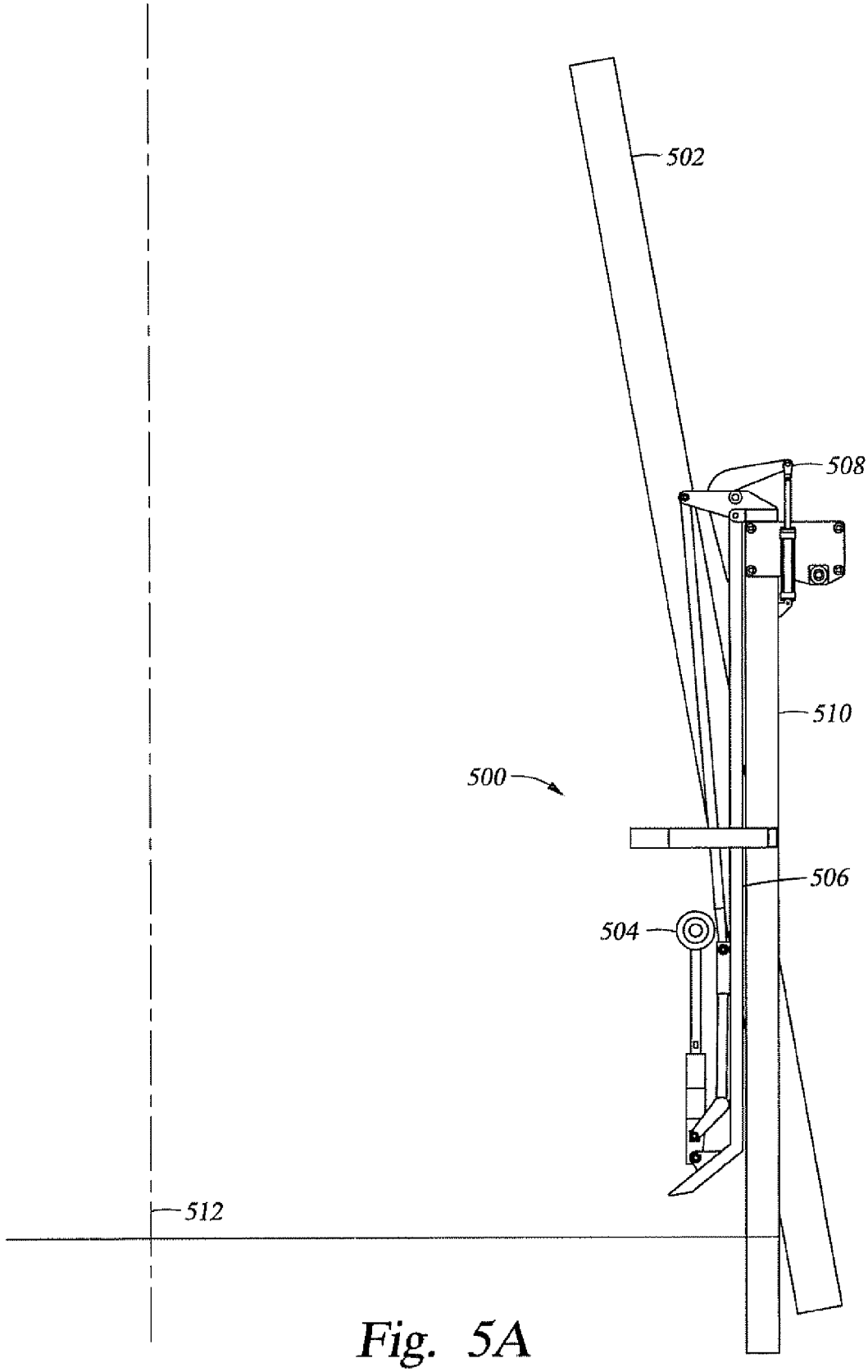
FIGS. 5A and 5B illustrate a pipe guidance system constructed in accordance with embodiments of the invention.
Figure 5B:
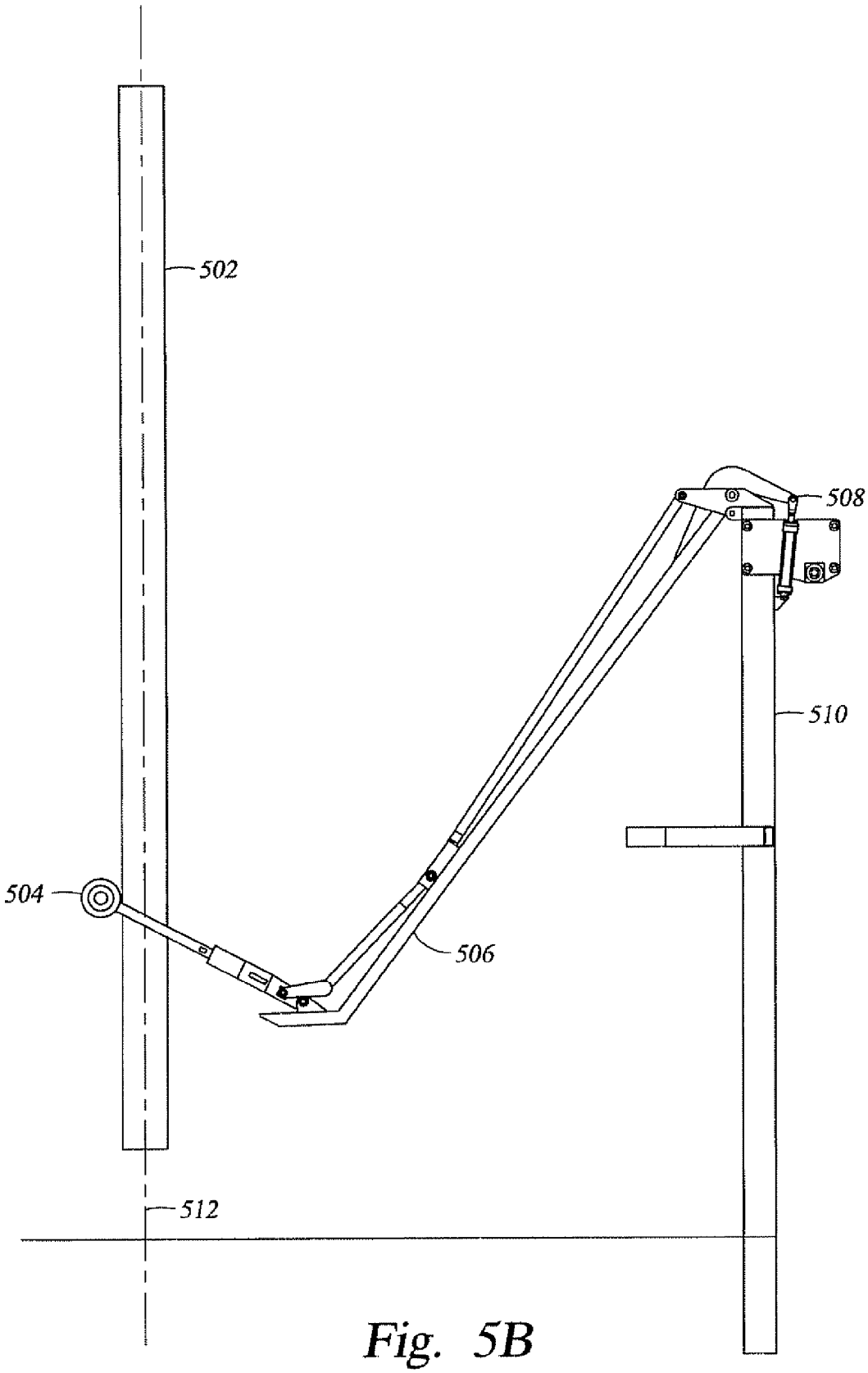
Figure 6:
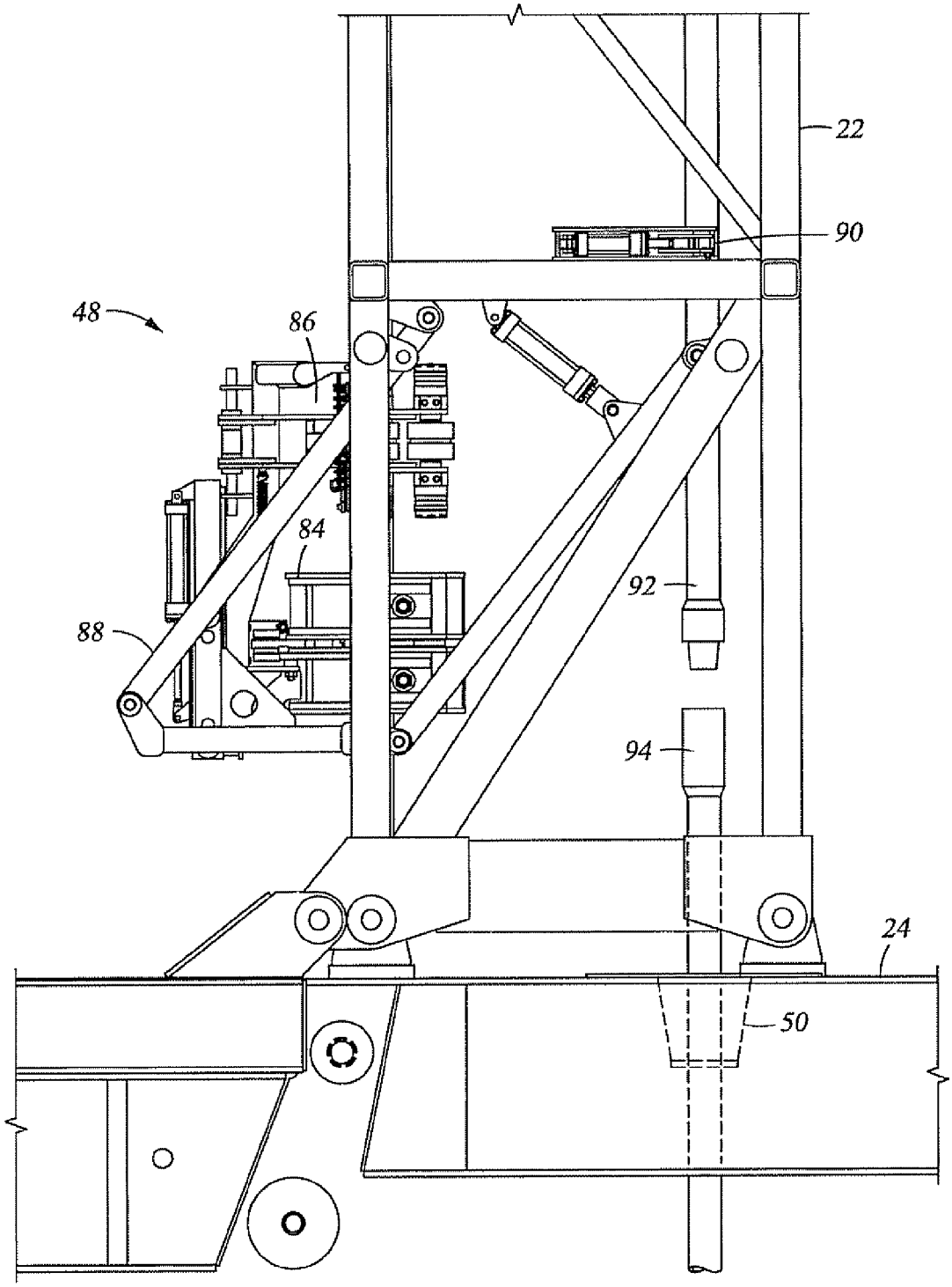
FIGS. 6 and 7 show drill floor equipment constructed in accordance with embodiments of the invention.

When pipe 412 is lifted into rig 416 from angled ramp 414 it may be desirable to control the lateral movement of the lower end of pipe 412 so that the pipe does not swing once lifted from the ramp. Pipe guide system 500, as shown in FIGS. 5A-B, provides guidance to pipe 502 as it is moved toward well center 512. Pipe guide system 500 comprises guide wheel 504, articulated arm 506, control cylinder 508, and frame 510. Frame 510 supports arm 506 and allows pipe 502 to be lifted into the rig from an angled ramp. Guide wheel 504 engages pipe 512 and control the lower end of pipe 512 as the pipe moves toward vertical as it is lifted into the rig. Guide wheel 504 is supported by articulated arm 506, the extension of which is controlled by control cylinder 508. Once pipe 502 is on well center 512, wheel 504 disengages the pipe and is returned to its initial position by articulated arm 506, Referring back to FIG. 1, drill floor equipment 20, comprising iron roughneck system 48 and slips 50, is used to make and break pipe connections as pipe joints are added to, or removed from, the drill string. The operation of drill floor equipment 20 is further shown in FIGS. 6 and 7. Iron roughneck system 48 comprises torque wrench 84 and spinner 86 mounted to swinging frame 88 and stabbing guide 90 mounted to mast 22. Swinging frame 88 forms a parallelogram-shaped support structure that allows roughneck system 48 to be moved to and from well center as needed.

Figure 7:
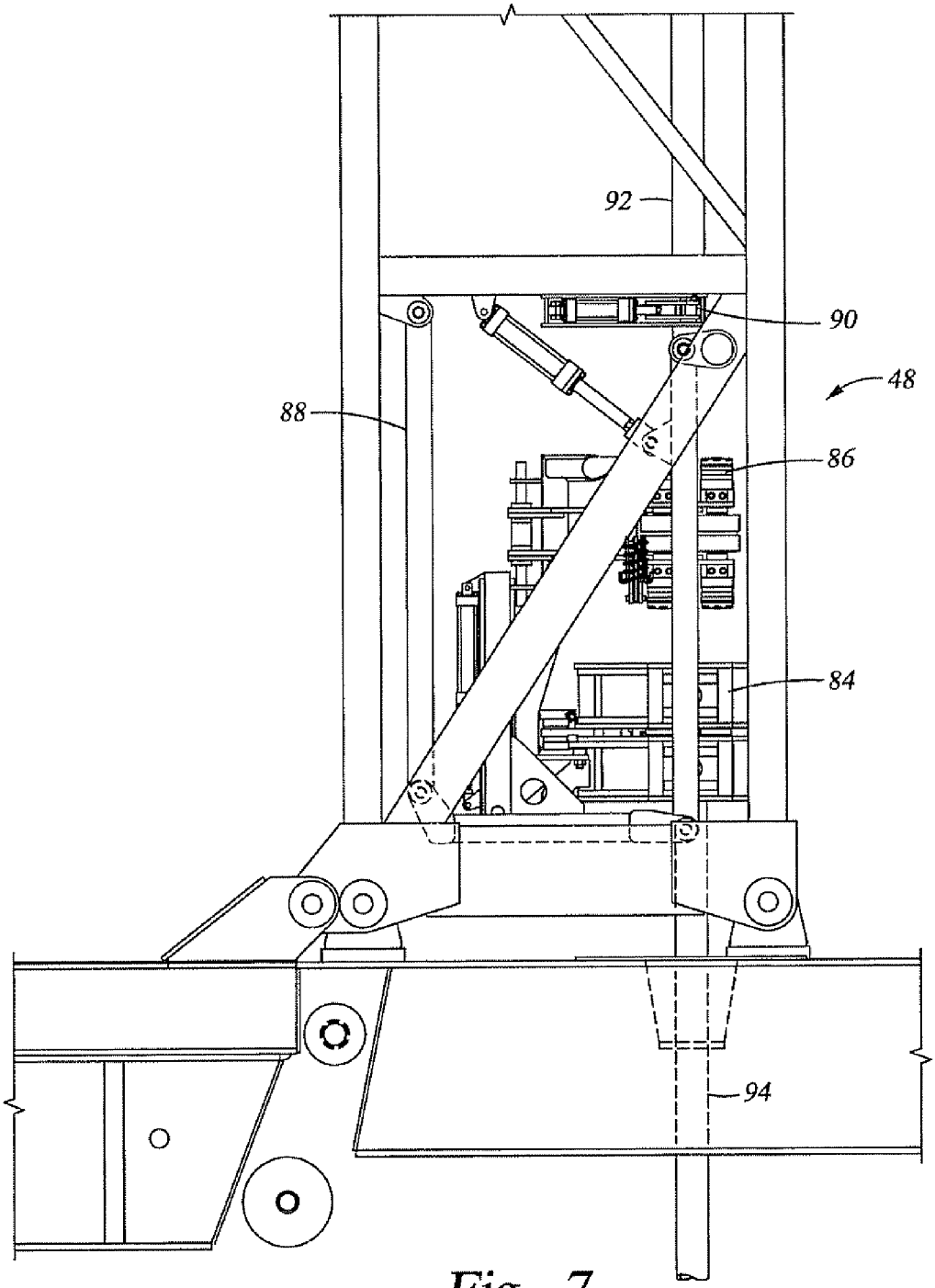

As pipe joint 92 is lowered, stabbing guide 90 aligns the pipe joint with drill string 94, which is supported by slips 50, As pipe joint 92 engages drill string 94, swinging frame 88 moves torque wrench 84 and spinner 86 toward the well center, as shown in FIG. 7. Spinner 86 engages pipe joint 92 and rotates the pipe so as to engage the threaded connection to drill string 94. Torque wrench 84 then applies the necessary torque to the threaded connection to secure the connection. When removing pipe joints from the drill string torque wrench 84 applies torque to break the connection and spinner 86 rotates the pipe joint to disengage the treaded connection.

Figure 8A:
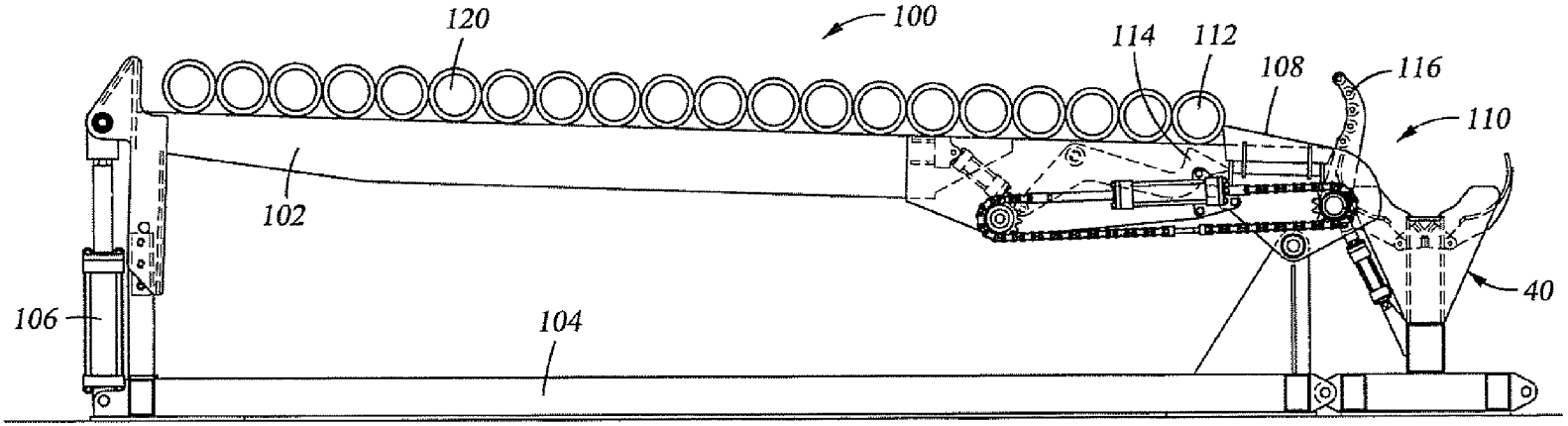
FIGS. 8A-F illustrate the loading of pipe from a pipe handling system constructed in accordance with embodiments of the invention.
Figure 8B:
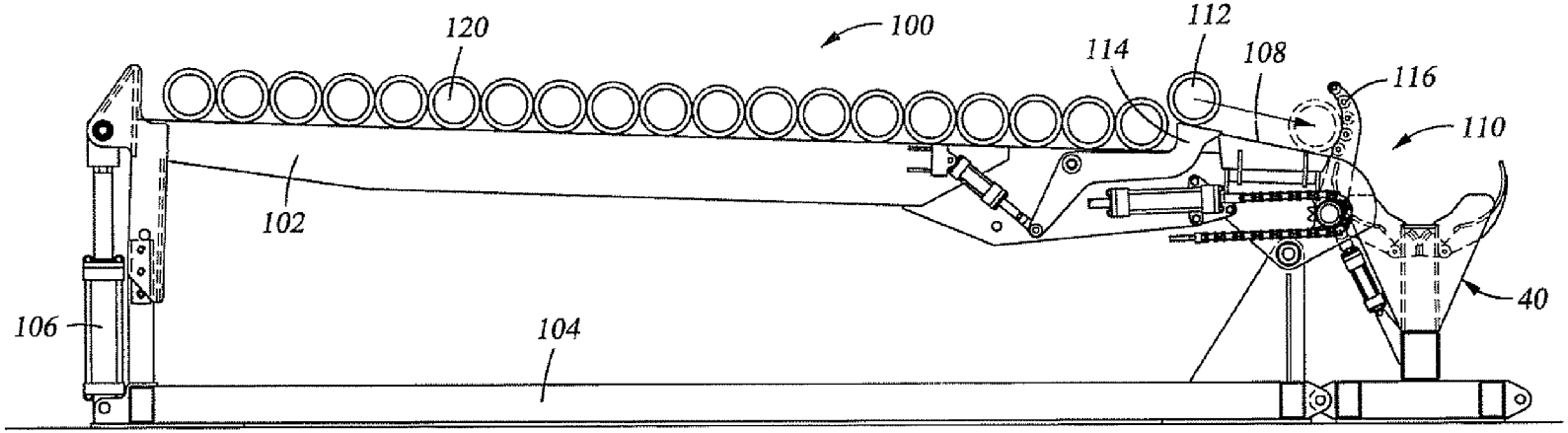
Figure 8C:
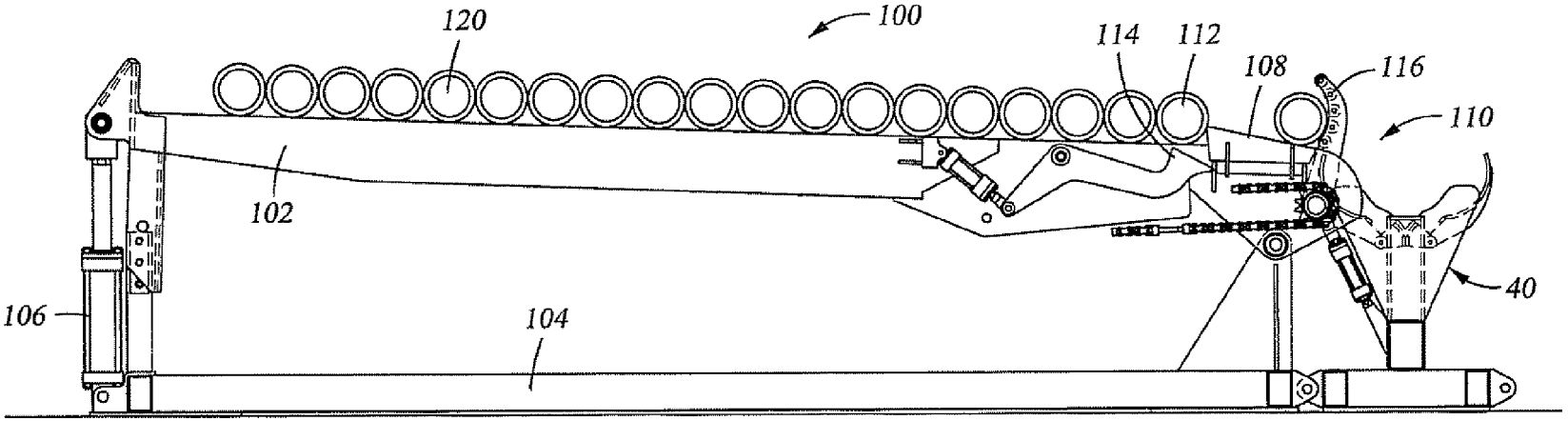
Figure 8D:
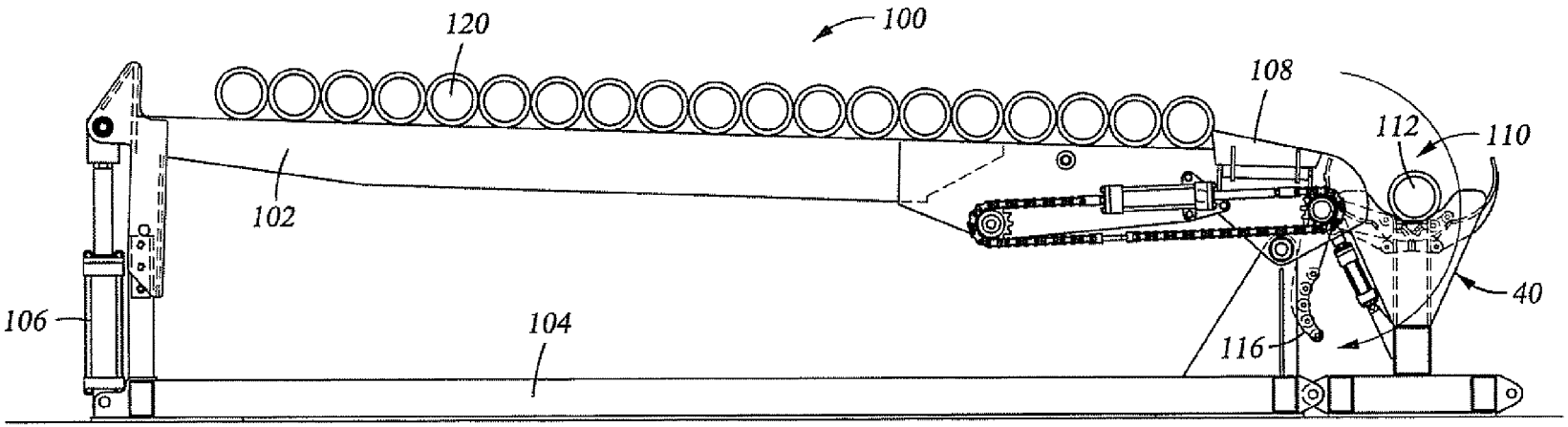
Figure 8E:
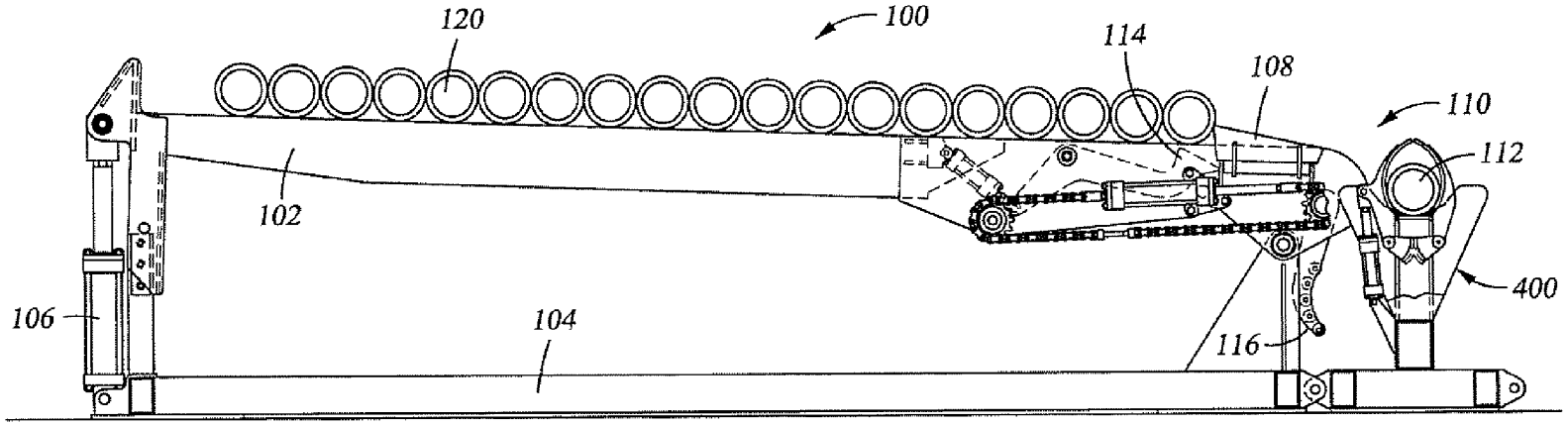
Figure 8F:
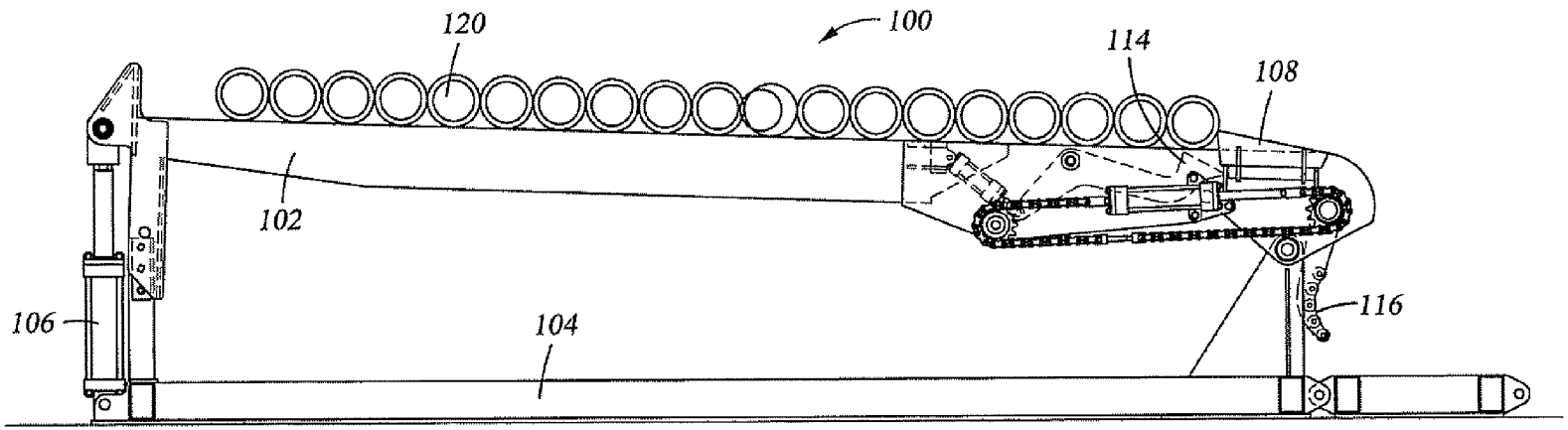
Figure 9A:
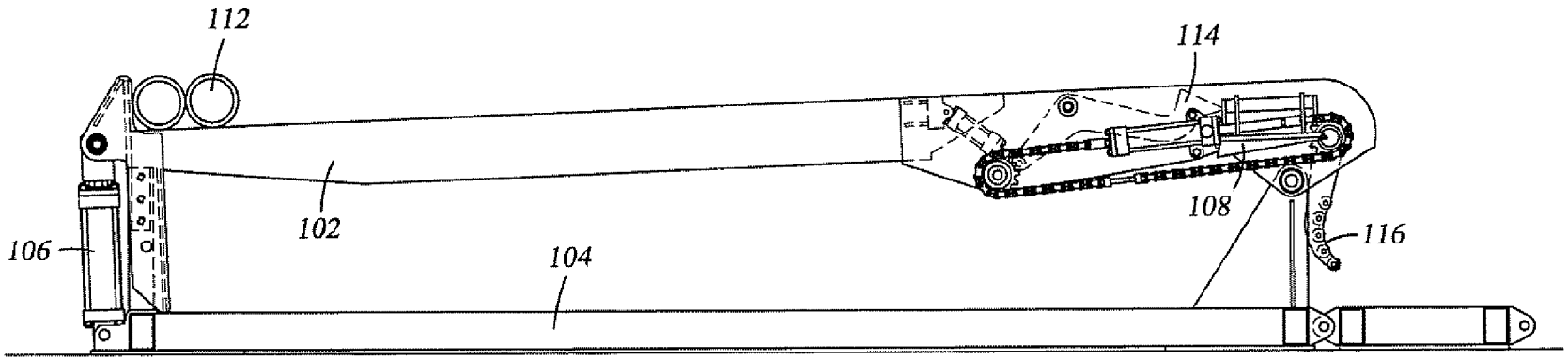
FIGS. 9A-F illustrate the loading of pipe onto the pipe handling system of FIGS. 8A-F, FIGS. 10A-H illustrate the loading of pipe from a pipe handling system constructed in accordance with embodiments of the invention.
Figure 9B:
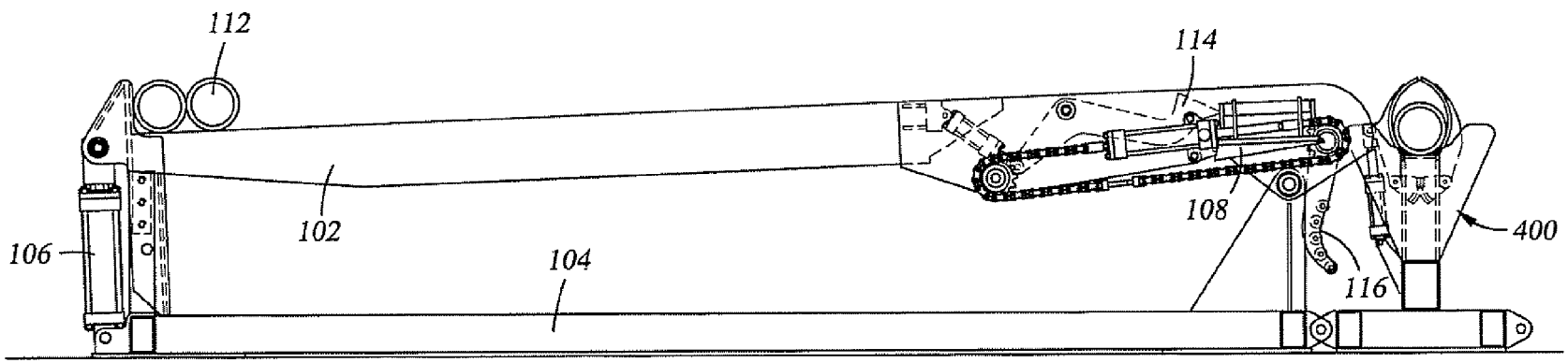
Figure 9C:
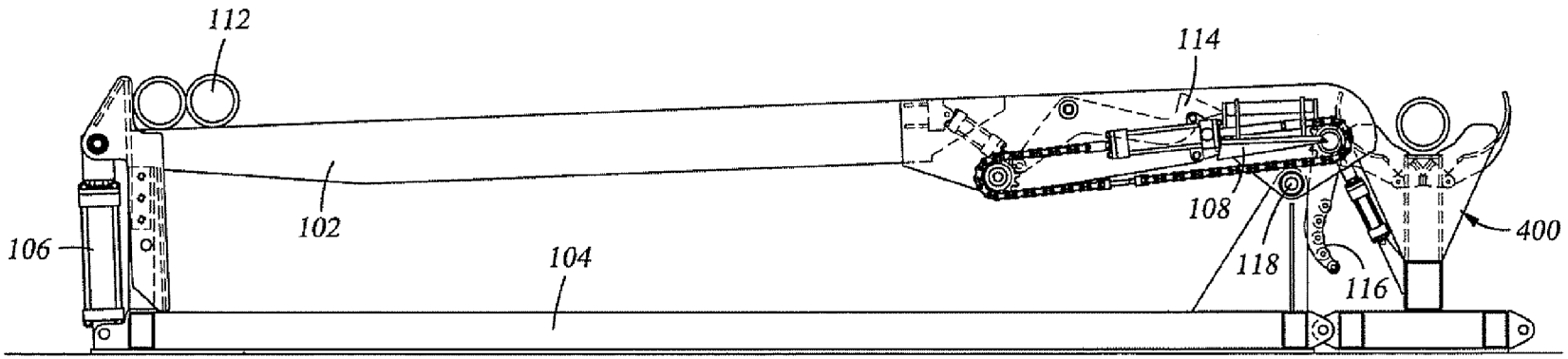
Figure 9D:
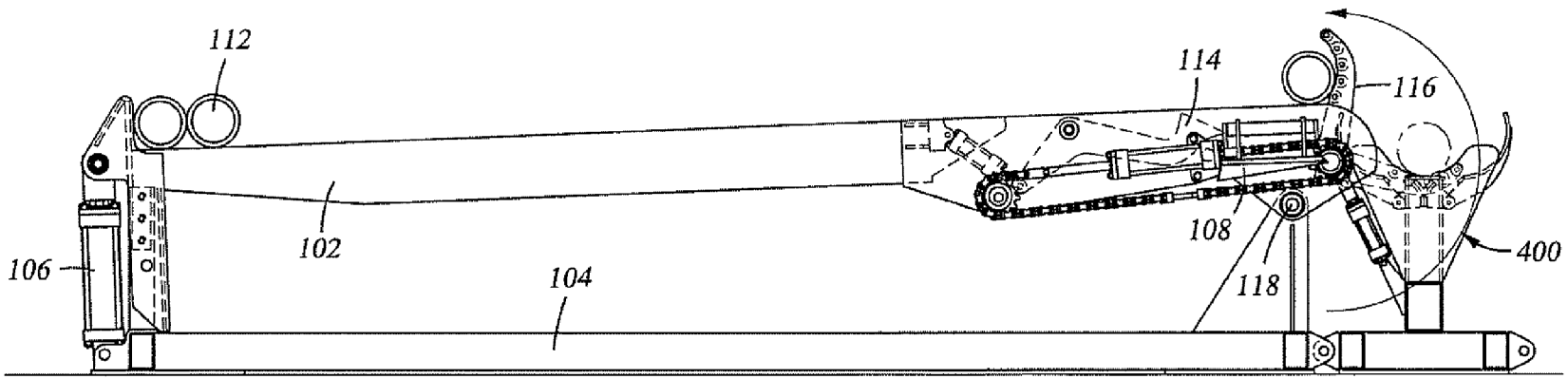
Figure 9E:
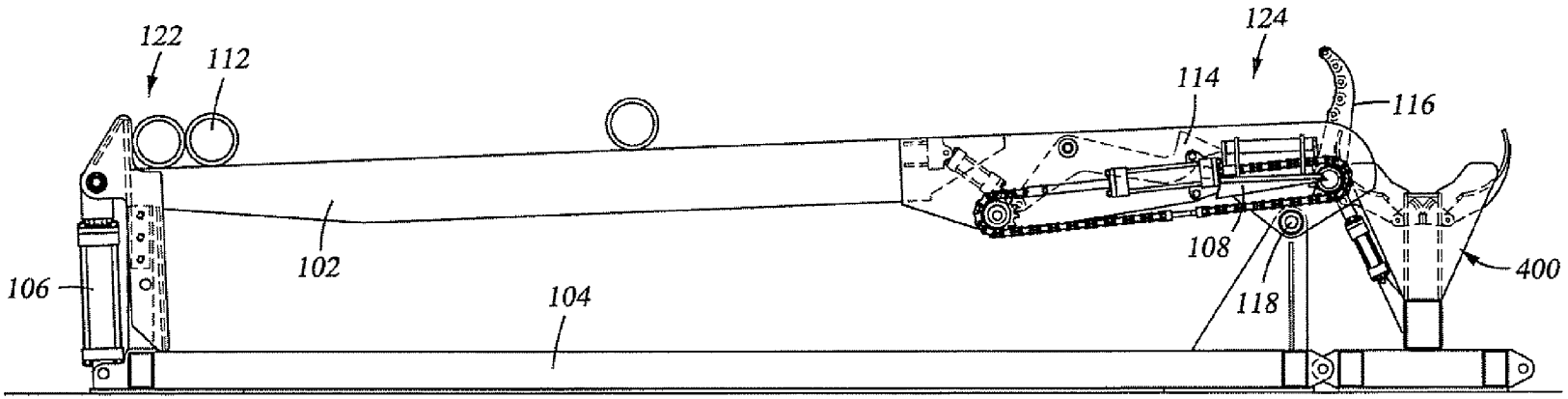
Figure 9F:
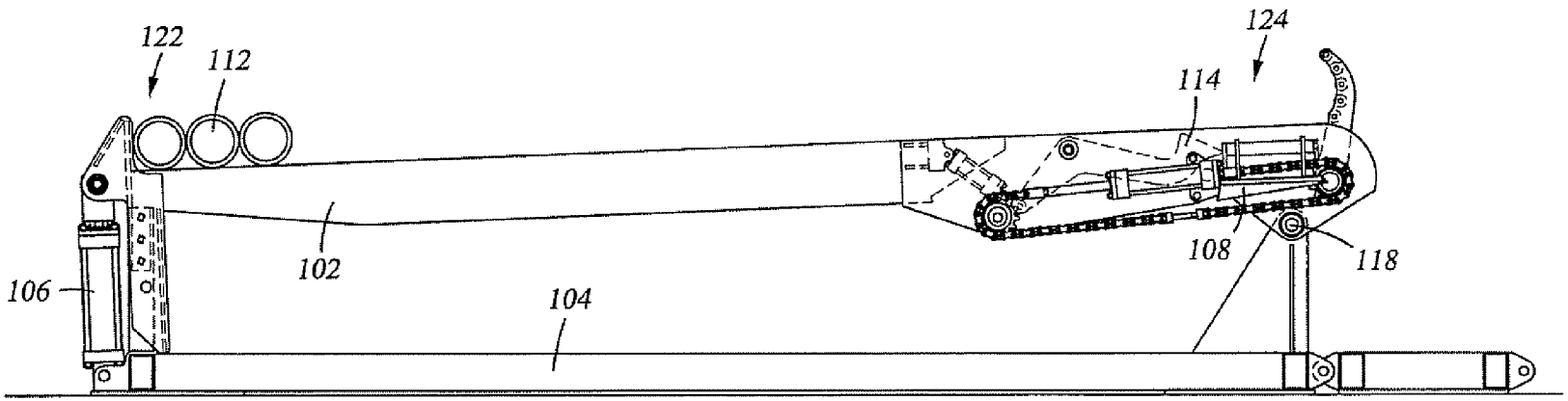

Referring now to FIG. 8A, pipe handling system 100 comprises rack 102, frame 104, tilting mechanism 106, elevated stop 108, and pipe unloading assembly 110. Unloading assembly 110 comprises lifting block 114 and rotating arm 116. When loading pipes 112 onto erector system 400, tilting mechanism 106 raises the end of rack 102 so as to angle the rack toward erector system 400. The movement of pipes 112 along rack 102 is limited by elevated stop 108

Referring now to FIGS. 8B-8F, to load a single joint of pipe 112 onto erector system 400, lifting block 114 is raised, pushing a single joint of pipe 112 upward. The pipe 112 moves over and past elevated stop 108 toward the end of rack 102. Lifting block 114 is then lowered so that the remainder of pipes 118 can move downward until contacting elevated stop 108. At the end of rack 102, pipe 112 is stopped by arm 116, which is disposed in a raised position. Arm 116 is then rotated to lower pipe 112 onto erector system 400. Arm 116 continues rotating downward so that is out of the way of erector system 400. Erector system 400 can then lift pipe 112 upward and away from pipe handling system 100.

FIGS. 9A-F illustrate pipe handling system 100 being used to store pipes being removed from a drill string. When moving pipes 112 from erector system 400, tilting mechanism 106 lowers the end of rack 102 so as to angle the rack away from erector system 400. Lifting block 114 and elevated stop 108 are retracted into rack 102 so as to provide a smooth surface along which pipe 112 can roll. Once pipe 112 is lowered and released by erector system 400, arm 116 rotates upward so as to lift the pipe from the erector. Arm 116 continues to rotate until pipe 112 falls onto rack 102 where it will roll toward the far end of the rack.

Another pipe handling system is shown in FIGS. 10A-H and 11A-H. Pipe handling system 200 comprises frame 202 that is pivotally mounted on base 204. The incline of frame 202 is controlled by piston 206. The loading and unloading of pipe into handling system 200 is done by pipe moving assembly 210. Pipe moving assembly 210 comprises extendable finger 214, rotatable arm 216, and drive motor 218. Assembly 210 is slidably mounted to a vertical member of frame 202 so that drive motor 218 engages gear rack 220.

Figure 10A:
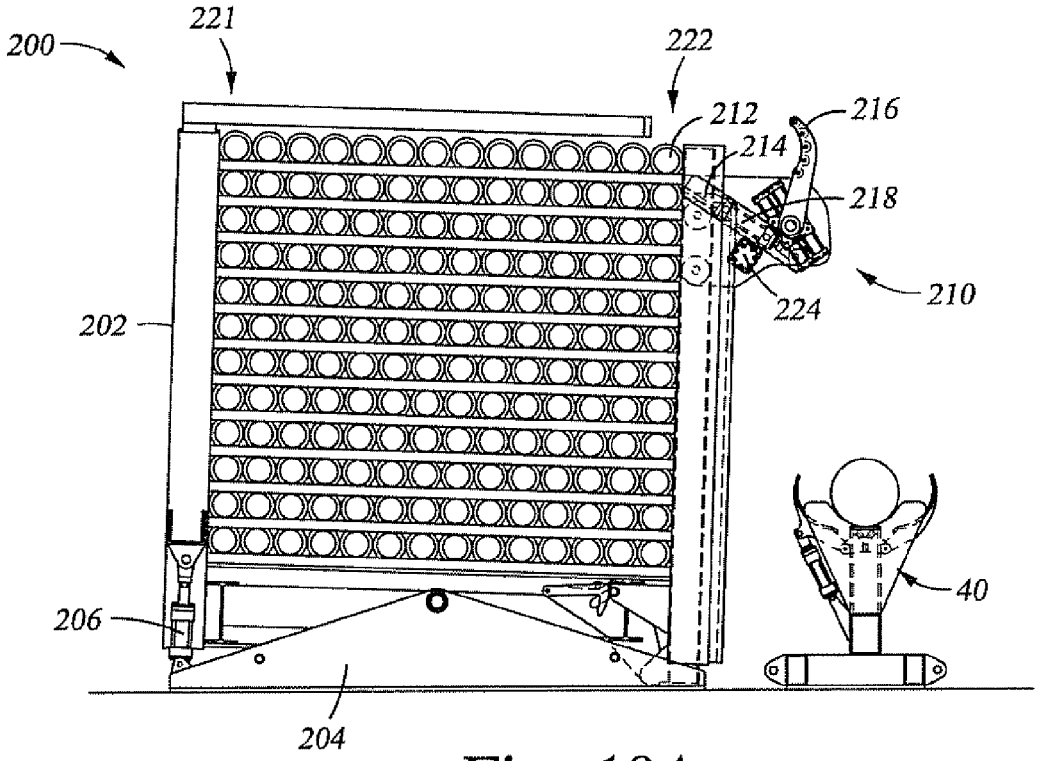
Figure 10B:
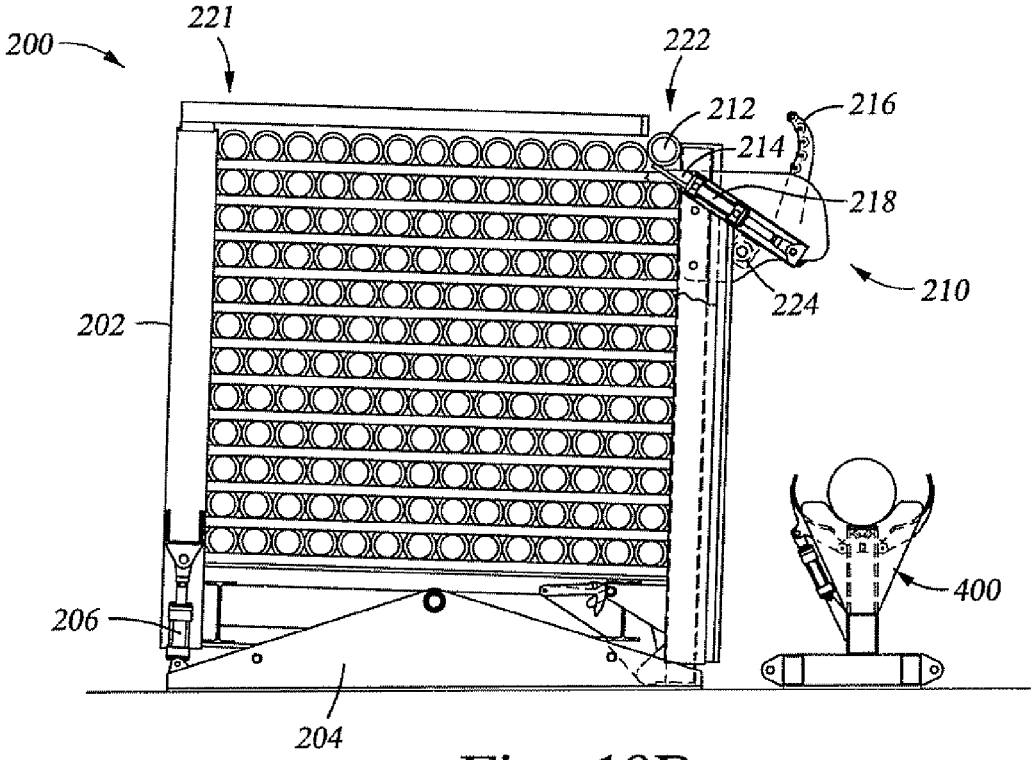
Figure 10C:
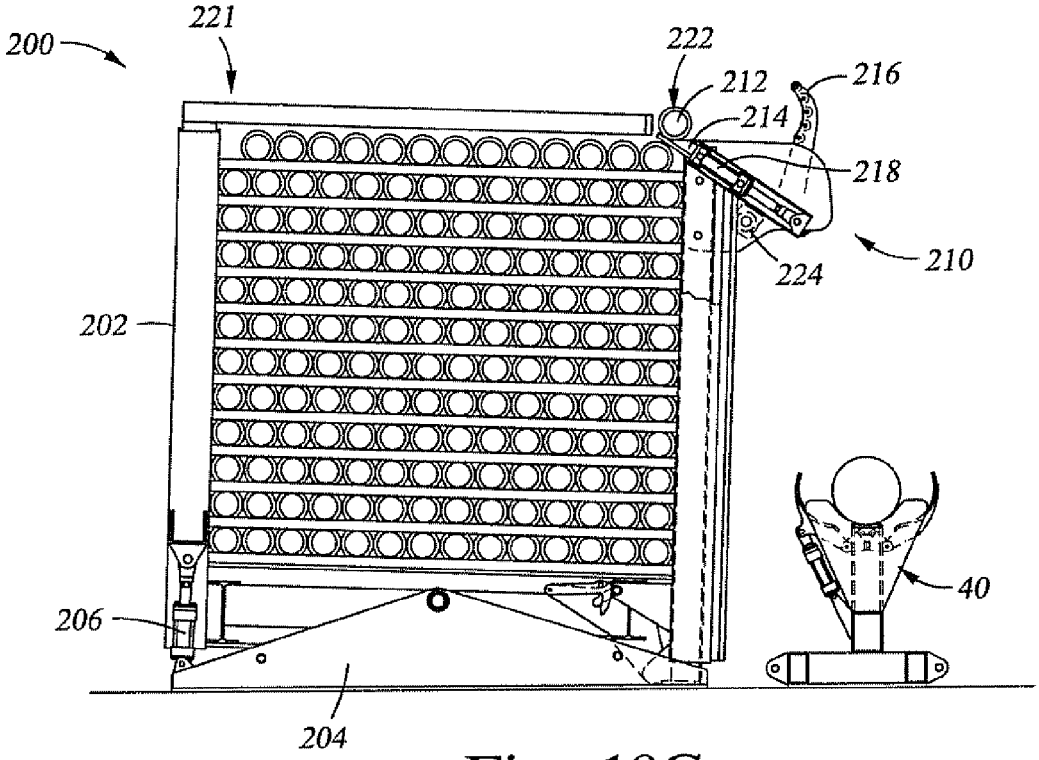
Figure 10D:
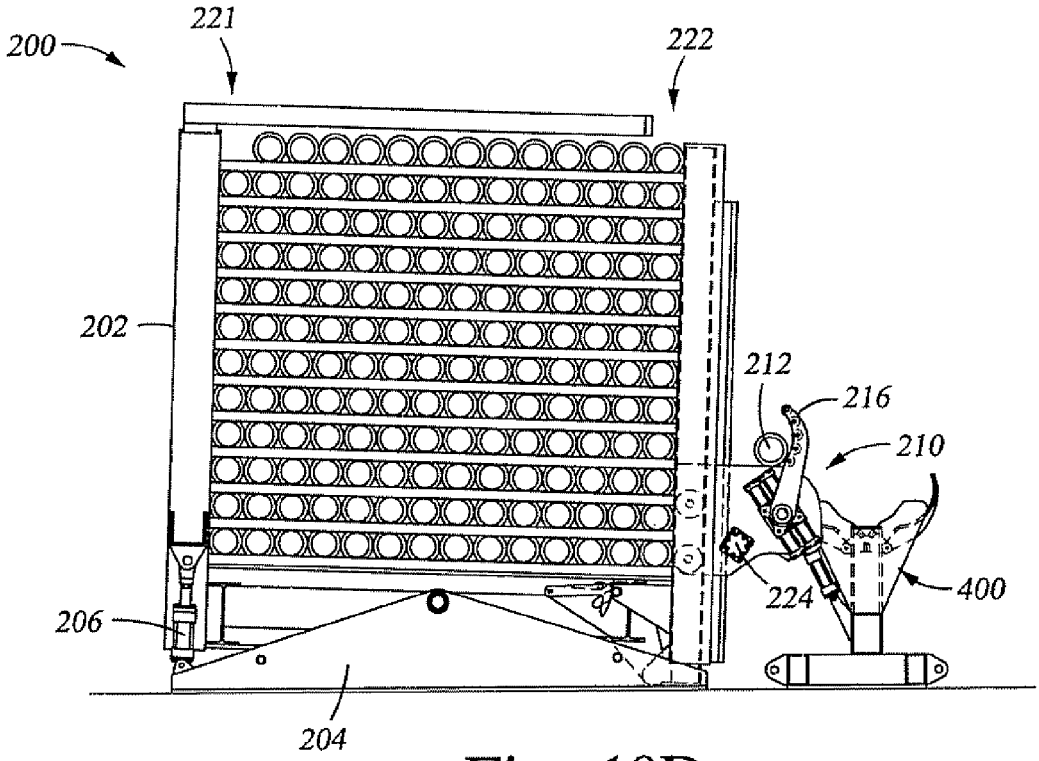
Figure 10E:
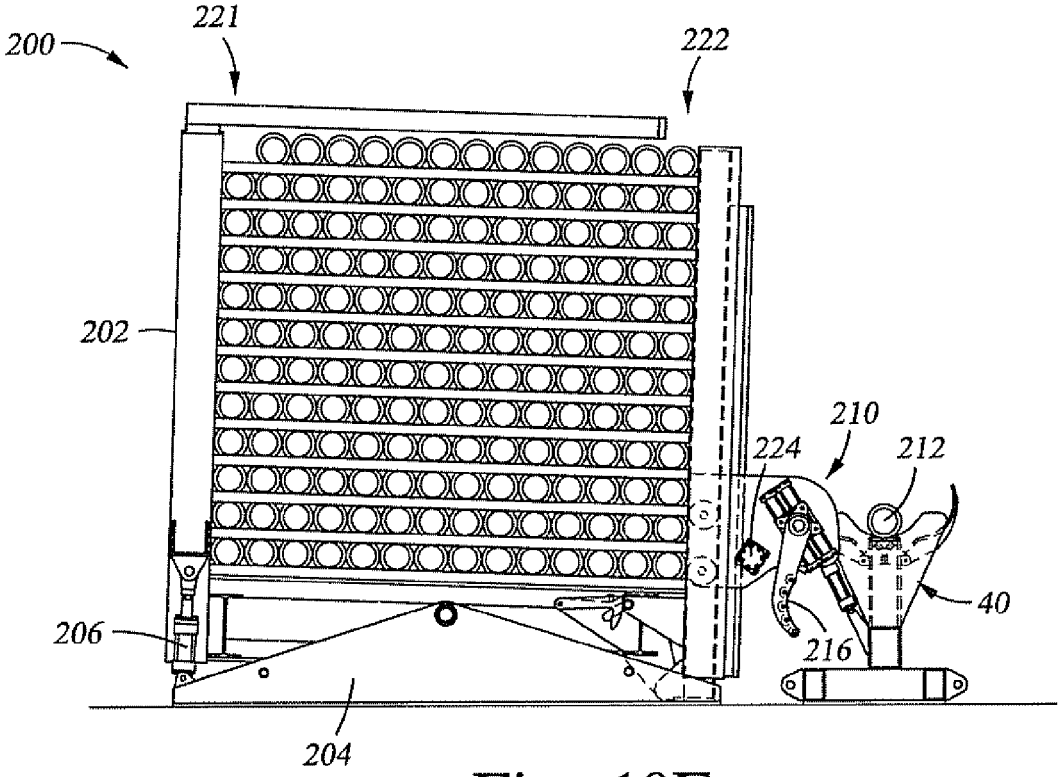
Figure 10F:
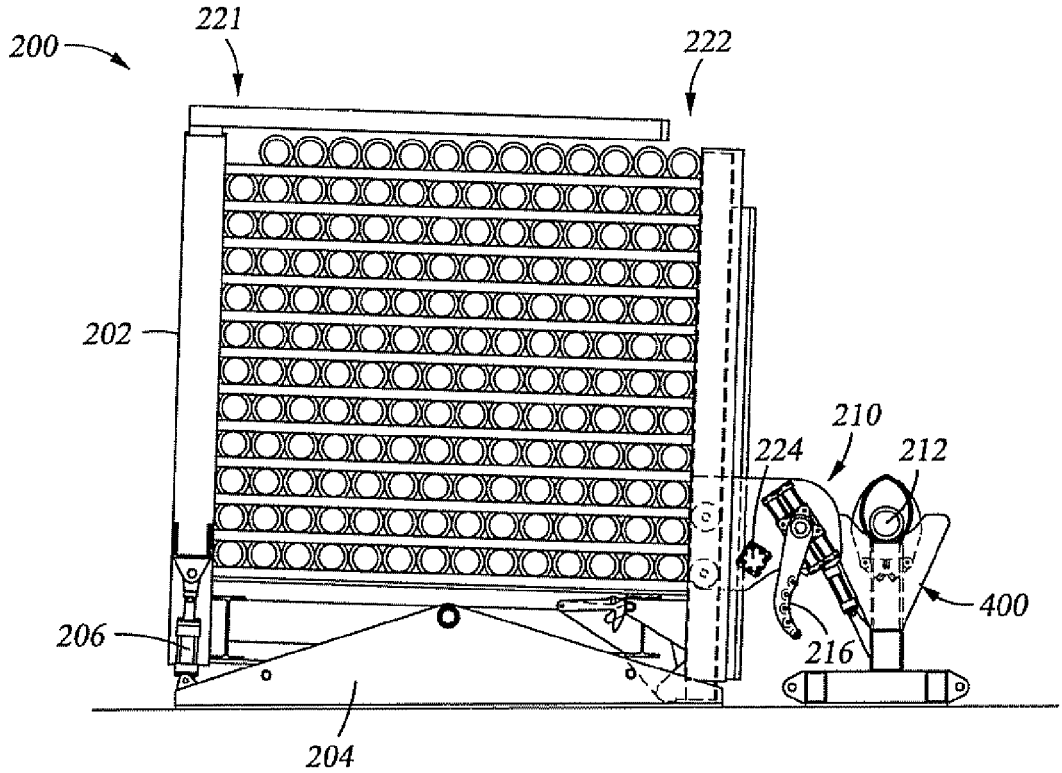
Figure 10G:
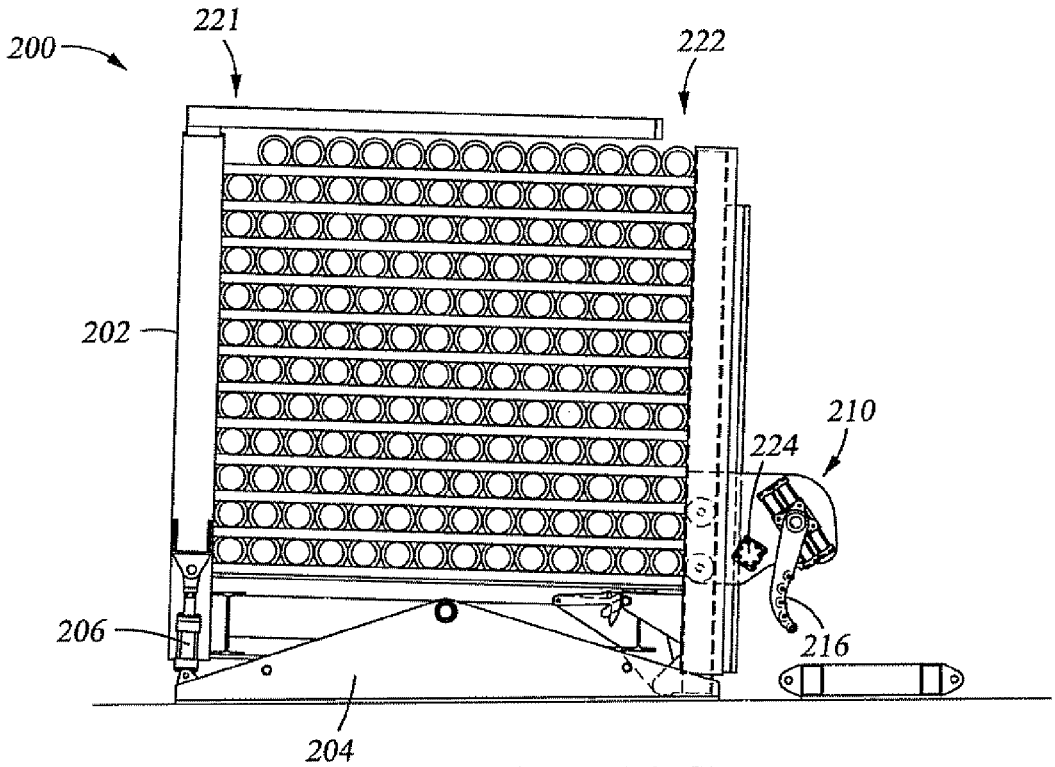
Figure 10H:
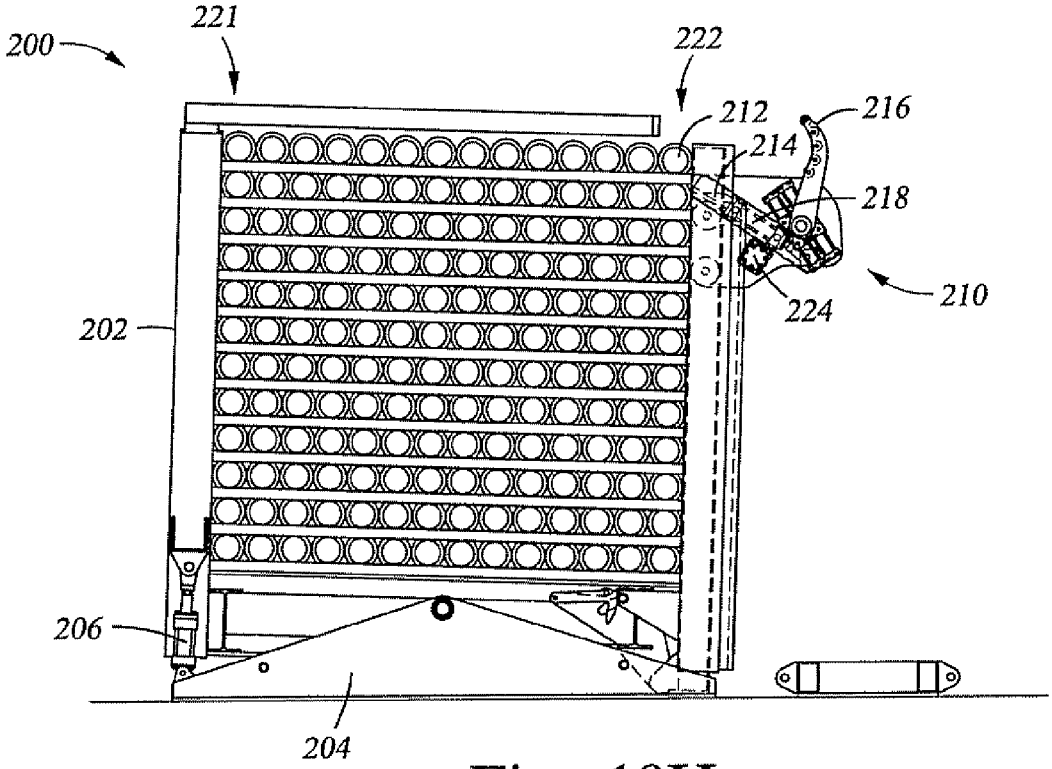
Figure 11A:
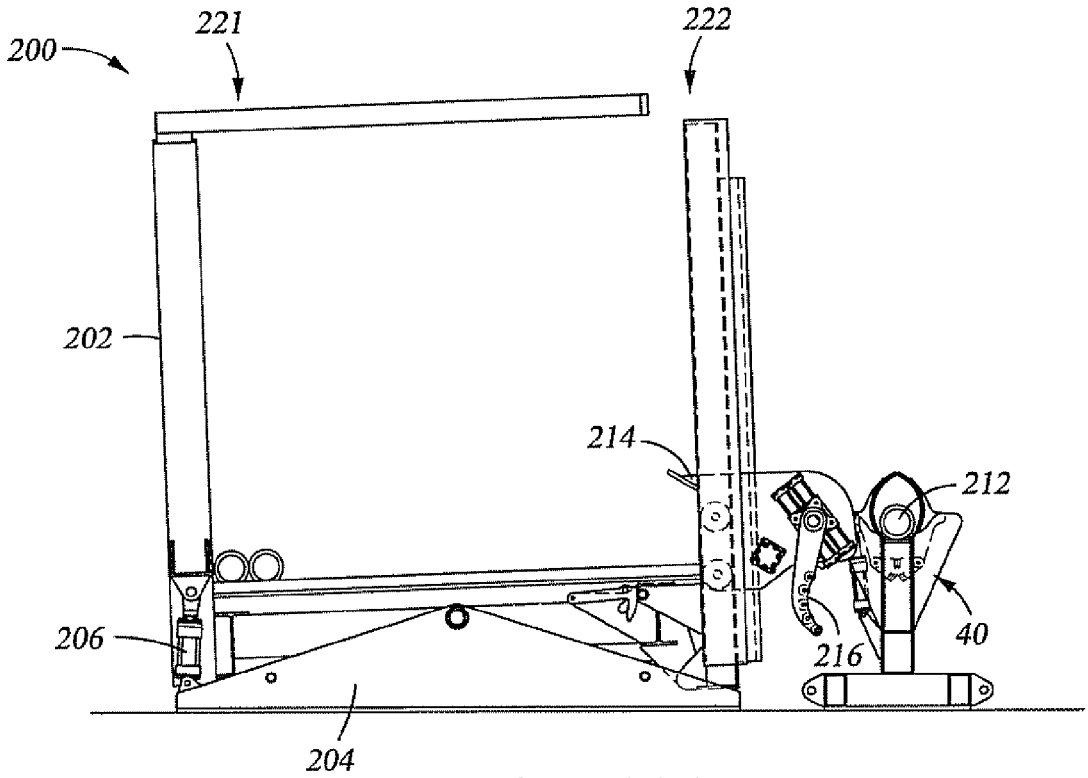
FIGS. 11A-H illustrate the loading of pipe onto the pipe handling system of FIGS. 10A-H.
Figure 11B:
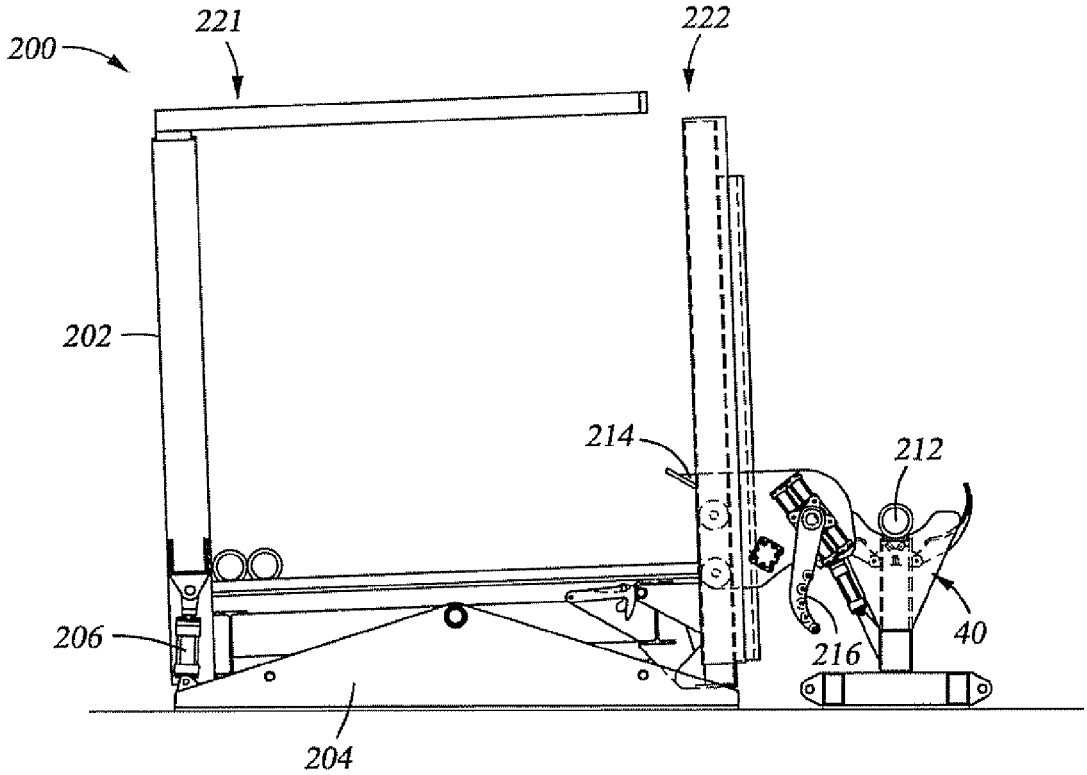
Figure 11C:
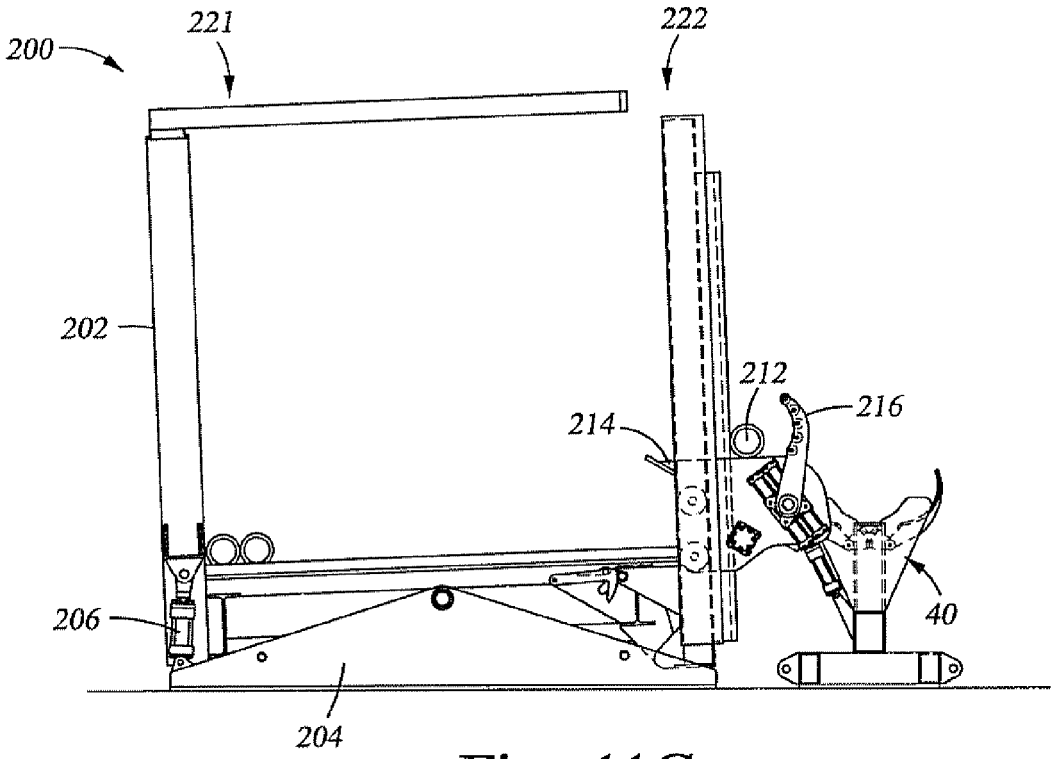
Figure 11D:
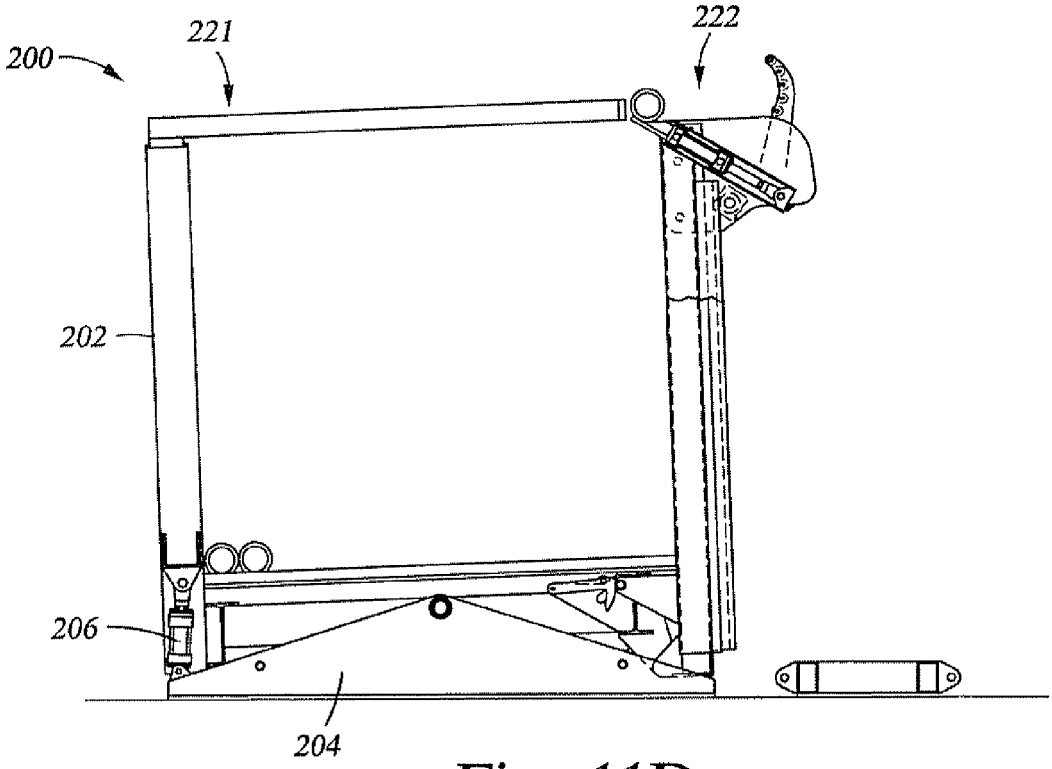
Figure 11E:
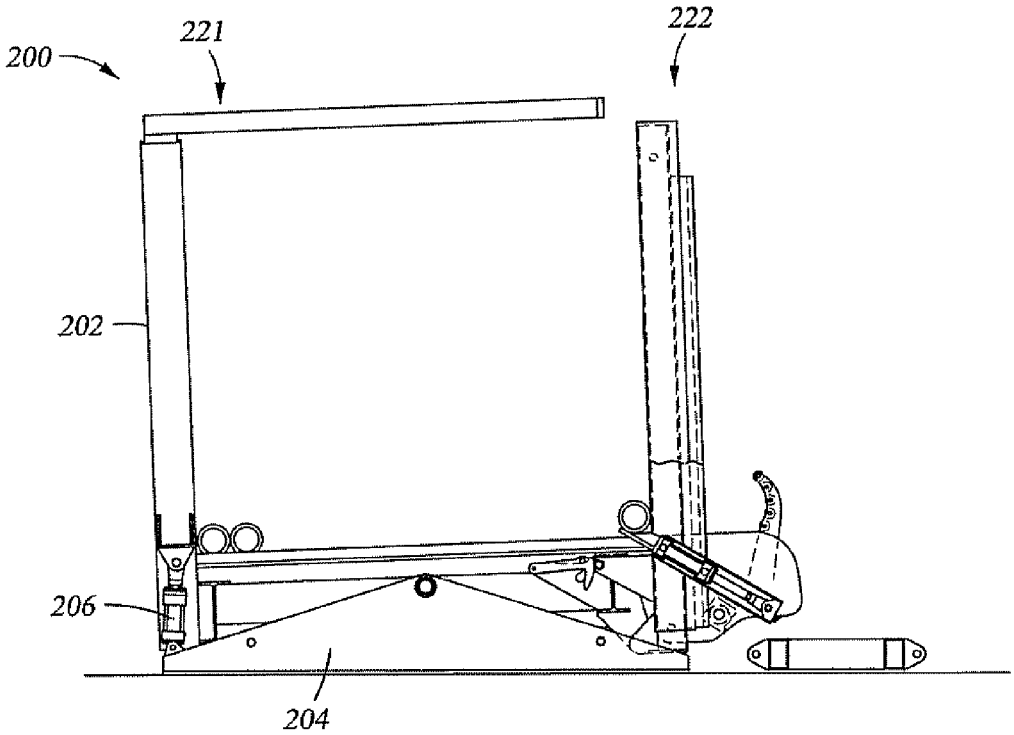
Figure 11F:
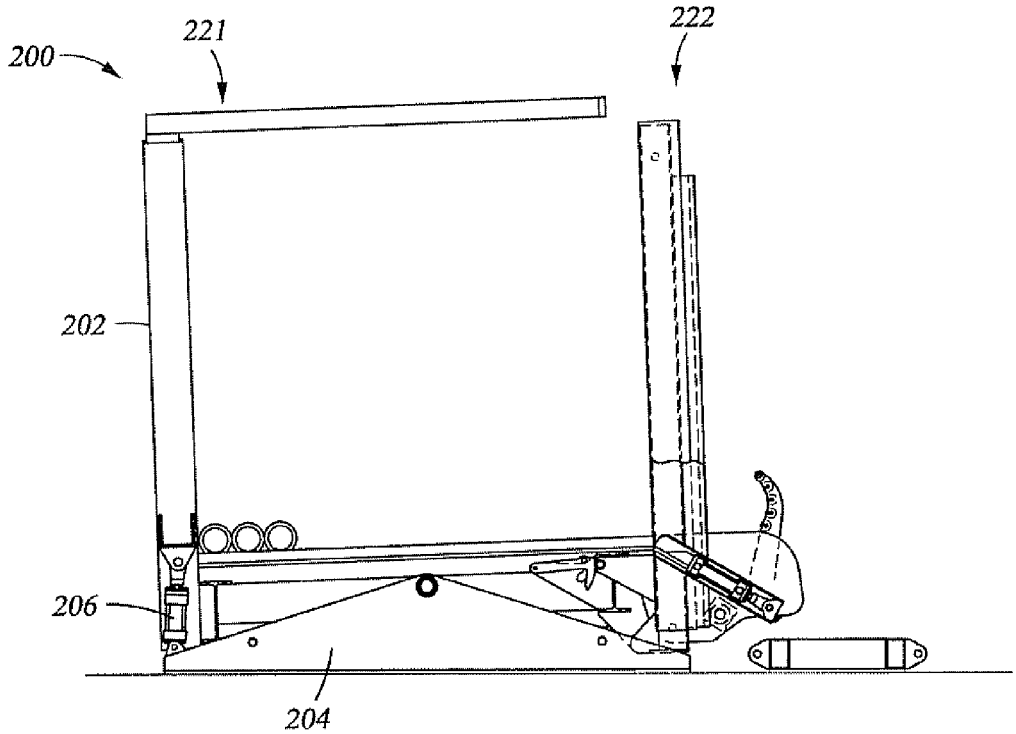
Figure 11G:
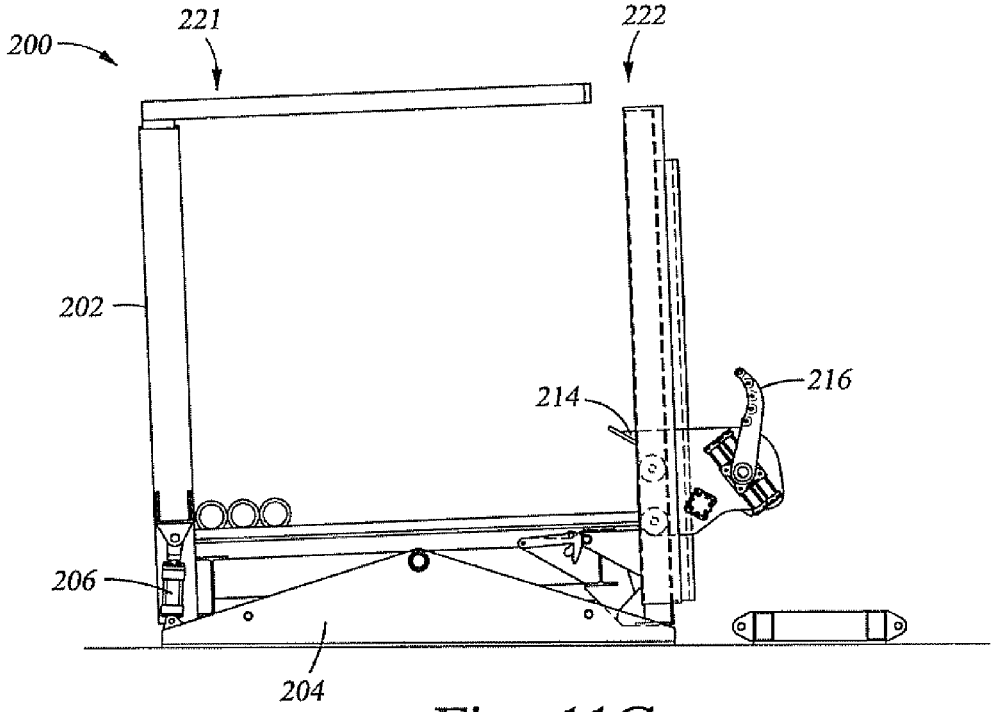
Figure 11H:
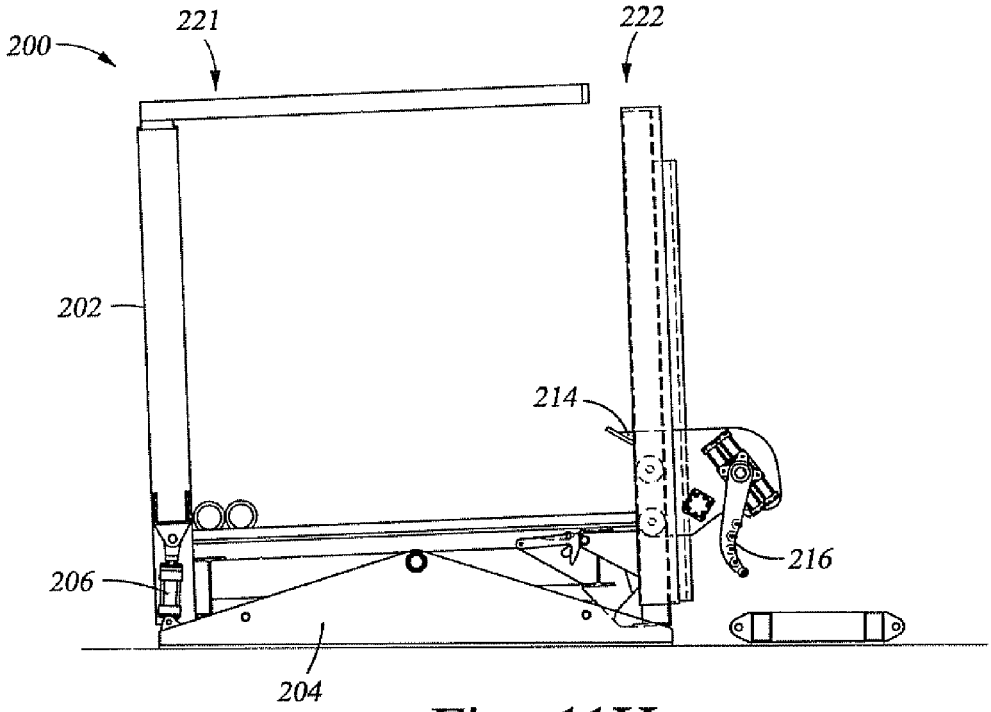

The unloading of pipe from handling system 200 is illustrated in FIGS. 10A-H. Piston 206 inclines frame 202 so that pipe joints 212 tend to move toward pipe moving assembly 210. Finger 214 extends to separate a single joint of pipe from the row of pipes stored in frame 202. Assembly 210 the moves upward until pipe 212 clears frame 202, as shown in FIG. 10B. Pipe 212 will roll down assembly 210 until it contacts arm 216, which is in an elevated position. With pipe 212 resting against arm 216, assembly 210 moves downward along frame 202 to the position shown in FIG. 10D. Arm 216 then rotates so as to lower pipe 212 into erector system 400 and continues rotating until reaching a lowered position as shown in FIG. 10E. With am 216 in a lowered position, erector system 400 can capture pipe 212 and move the pipe to the drill floor. Once erector system 400 has moved out of the way, assembly 210 is moved back to uppermost row of pipes and arm 216 is rotated back to the elevated position.

The loading of pipe from erector system 400 back into handling system 200 is illustrated in FIGS. 11A-H Piston 206 inclines frame 202 so that pipe joints 212 tend to move away from moving assembly 210. Mover assembly 210 is disposed adjacent to erector system 400, once erector system 400 lowers pipe 212 to a horizontal position Once erector system 400 disengages pipe 212, arm 216 rotates to lift pipe 212 from erector system 400. Mover assembly 210 then moves up frame 202 until pipe 212 clears the top of the frame. Once inside frame 202, pipe 212 is restrained by extended finger 214 and bumper 215. Mover assembly 210 moves back down frame 202 until pipe 212 is at the row of pipe being loaded. Finger 214 then retracts and pipe 212 will roll into position within frame 202. Mover assembly 210 is then moved back to the proper elevation to receive pipe from erector system 400 and arm 216 is rotated back to its lowered position.

The use of pipe or drill pipe herein is understood that the handling systems described herein are equally usable for other tubular members, such as casing, drill collar, and other oilfield tubulars. While preferred embodiments of this invention have been shown and described, modifications thereof can be made by one skilled in the art without departing from the scope or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims that follow, the scope of which shall include all equivalents of the subject matter of the claims.

The invention claimed is:

1. A pipe handling system comprising:

a pipe erector including a frame and a plurality of pipe guides coupled to said frame, wherein said frame is pivotally and slidably coupled to a rail and said pipe guides are configured to receive a pipe, said pipe erector operable to move the pipe from a horizontal storage position to an inclined position where an upper end of the pipe is adjacent to an elevated drill floor of a drilling rig, wherein in the inclined position, the pipe is at an angle between horizontal and vertical; and a guide system operable to engage the pipe and control lateral movement of the pipe as it is moved from being supported in the inclined position by the pipe erector to a vertical position supported by the drilling rig.

2. The pipe handling system of claim 1 wherein said pipe erector further comprises an elevating cylinder that pivots said frame relative to the rail.

3. The pipe handling system of claim 1 wherein said guide system further comprises:

a frame coupled to said drilling rig;

an articulated arm moveably mounted to said frame; and a guide wheel supported by said articulated arm, wherein said guide wheel is configured to engage the pipe.

4. The pipe handling system of claim 3 wherein said guide system further comprises a control cylinder coupled to said articulated arm, wherein said control cylinder controls the extension of said articulated arm.

5. The pipe handling system of claim 1 wherein the drilling rig further comprises an elevator that engages the upper end of the pipe when the pipe is supported by said pipe erector in the inclined position, wherein vertical movement of the pipe is controlled by said elevator.

6. The pipe handling system of claim 1 further comprising a horizontal pipe loading system configured to move pipes in the horizontal loading position to and from said pipe erector.

7. A drilling system comprising:

a drilling rig having an elevated drill floor;

a pipe erector operable to move a pipe from a horizontal storage position to an inclined position where an upper end of the pipe is adjacent to the elevated drill floor, wherein in the inclined position, the pipe is at an angle between horizontal and vertical and the upper end of the pipe is offset from well center; and a guide system including a frame coupled to said drilling rig and an arm pivotally mounted to said frame and articulated for angular movement, said guide system operable to engage the pipe with said pivotal and articulated arm and control lateral movement of the pipe toward well center as the pipe is moved from being supported in the inclined position by the pipe erector to a vertical position supported by the drilling rig.

8. The drilling system of claim 7 wherein said pipe erector further comprises:

a frame pivotally and slidably coupled to a rail; and a plurality of pipe guides coupled to said frame.

9. The drilling system of claim 8 wherein said pipe erector further comprises an elevating cylinder that pivots said frame relative to the rail.

10. The drilling system of claim 7 wherein said guide system further comprises a guide wheel supported by said articulated arm, wherein said guide wheel is configured to engage the pipe.

11. The drilling system of claim 10 wherein said guide system further comprises a control cylinder coupled to said articulated arm, wherein said control cylinder controls the extension of said articulated arm.

12. The drilling system of claim 7 wherein the drilling rig further comprises an elevator that engages the upper end of the pipe when the pipe is supported by said pipe erector in the inclined position, wherein vertical movement of the pipe is controlled by said elevator.

13. The drilling system of claim 7 further comprising a horizontal pipe loading system configured to move pipes in the horizontal loading position to and from said pipe erector.

14. A pipe handling method comprising:

moving a pipe from a horizontal storage position onto a pipe erector system;

pivoting the pipe erector system so that the pipe is at an angle between horizontal and vertical;

moving the pipe erector system so that an upper end of the pipe is proximate to an elevated drill floor of a drilling rig;

engaging the upper end of the pipe with a pipe elevator supported by the drilling rig;

lifting the pipe by raising the elevator within the drilling rig;

engaging the pipe with a guide system while the pipe is being lifted; and pivoting an end and angling an articulation of an arm of the guide system to guide the pipe to a vertical position using the guide system to control lateral movement of the pipe as the pipe is lifted.

15. The pipe handling method of claim 14 further comprising:

aligning the pipe with a drill string supported by the drilling rig;

disengaging the guide system from the pipe; and engaging the pipe with the drill string.

16. The pipe handling method of claim 14 wherein the pipe erector system comprises a frame that supports the pipe as the pipe pivots between the horizontal storage position and the inclined position, wherein the frame also moves along a rail so as to position the upper end of the pipe proximate to the elevated drill floor.

17. The pipe handling method of claim 14 wherein the guide system comprises a guide wheel supported by the articulated arm, wherein the guide wheel is configured to engage the pipe as it is lifted by the elevator.

* * * * *